US011918094B2

(12) United States Patent
Sunderland et al.

(10) Patent No.: US 11,918,094 B2
(45) Date of Patent: Mar. 5, 2024

(54) APPARATUS FOR CURLING HAIR

(71) Applicant: The House of Curls LTD, North Yorkshire (GB)

(72) Inventors: Gary Sunderland, Yorkshire (GB); Gary Taylor, Yorkshire (GB)

(73) Assignee: THE HOUSE OF CURLS LTD, North Yorkshire (GB)

( * ) Notice: Subject to any disclaimer, the term of this patent is extended or adjusted under 35 U.S.C. 154(b) by 422 days.

(21) Appl. No.: 17/057,283

(22) PCT Filed: May 21, 2019

(86) PCT No.: PCT/GB2019/051398
§ 371 (c)(1),
(2) Date: Nov. 20, 2020

(87) PCT Pub. No.: WO2019/224529
PCT Pub. Date: Nov. 28, 2019

(65) Prior Publication Data

US 2021/0212430 A1 Jul. 15, 2021

(30) Foreign Application Priority Data

May 21, 2018 (GB) ..... 1808306

(51) Int. Cl.
*A45D 2/10* (2006.01)
*A45D 2/12* (2006.01)
*A45D 2/24* (2006.01)

(52) U.S. Cl.
CPC ..... *A45D 2/24* (2013.01); *A45D 2/122* (2013.01)

(58) Field of Classification Search
CPC . A45D 2/02; A45D 2/10; A45D 2/122; A45D 2/14; A45D 2/141; A45D 2/148;
(Continued)

(56) References Cited

U.S. PATENT DOCUMENTS 2,452,225 A * 10/1948 Coloccia ..... A45D 2/10 132/247
2,515,751 A * 7/1950 Warrington ..... A45D 2/10 132/245

(Continued)

*Primary Examiner* — Rachel R Steitz
(74) *Attorney, Agent, or Firm* — Culhane Meadows PLLC; Robert C. Klinger

(57) ABSTRACT

Apparatus for curling hair comprises first and second side portions ((12), (14)) which are secured together in a spaced apart relationship via a connector portion (16). The connector portion (16) is positioned substantially centrally with respect to each side portion. The connector portion (16) has a length of not more than 20 mm. The side portions ((12), (14)) are fabricated from a material which is both resilient and thermally conductive. The first side portion (12) is substantially flat and the second side portion (14) is configured such that it is provided with two fixed states: a first state in which the first side portion is convex in shape and bends away from the second plate; and a second fixed state in which the first side portion is concave in shape and folds over to cover both the connector portion and the first side portion. The first side portion is provided with at least one barrier member (18) extending from the first side portion towards the second side portion in substantially the same direction as the connector portion and spaced apart from the connector portion. The at least one barrier member (18) has a height and the ratio of the height of the barrier member to the length of the connector portion is at least 1:3.

20 Claims, 5 Drawing Sheets

(58) Field of Classification Search
CPC ..... A45D 2/20; A45D 2002/003; A45D 2002/025; H05B 3/44
See application file for complete search history.

(56) References Cited

U.S. PATENT DOCUMENTS

| | | | | |
|---|---|---|---|---|
| 2,713,864 | A * | 7/1955 | Solomon | A45D 2/02 D28/37 |
| 5,033,487 | A * | 7/1991 | Barradas | A45D 2/20 132/265 |
| 8,671,957 | B1 * | 3/2014 | James | A45D 2/10 132/247 |
| 2007/0084479 | A1 * | 4/2007 | Ryan-Jakimas | A45D 2/125 132/246 |

* cited by examiner

APPARATUS FOR CURLING HAIR

FIELD OF THE INVENTION

The present invention relates to apparatus and method for curling hair.

BACKGROUND OF THE INVENTION

Known apparatus for imparting curls to sections of hair include heated curling irons, curling tongs and wands, most of which comprise a cylindrical heated element attached to a handle. To use these devices each section of hair to be curled is wound around the heated element and then removed, repeating the action on different section of hair around the head.

Rollers are also commonly used for curling hair. Rollers may be unheated or can be pre-heated before use. Heated rollers comprise a hollow cylindrical roller body which is heated before use. A section of hair is wrapped around the roller from starting at the end of the hair and rolling towards the scalp. The roller is then secured at the scalp and heat from the roller transfers to the hair wrapped around it as the roller cools. Heated rollers are typically quite heavy and there is always a risk that the user may burn their fingers when putting the rollers into the hair. In addition, rollers can generally only be used to wrap hair in one direction, that is from the end of the hair to the scalp, thereby producing only one type of curl.

U.S. Pat. No. 8,671,957 describes a hair curling device having a flexible flat base portion, a stem secured to the base portion and a bowl portion which comprises a frusto-conical portion extending from the stem and having a flange extending from its top edge. With hair wrapped around the stem the frusto-conical portion is folded over so that the flange aligns with the base. The frusto-conical wall decreases in thickness from the stem to the flange where the thickness is smallest. The device relies on friction between the flange and the base to prevent the device unrolling and sliding down a user's hair. The hair curling devices are not designed to be heated directly.

WO2017/098282 to the present applicant describes a hair curling apparatus which comprises first and second side portions joined by a central stem, one of the first and second side portions has a convex and a concave configuration. Once hair is wrapped around the stem, the curved side portion is folded over to form a closed confirmation, enclosing the hair within the apparatus. The apparatus is thermally conductive and each can be heated individually. The apparatus relies on friction between internal flange and the base to prevent the unrolling of the hair within.

It would be desirable to provide an improved apparatus for curling hair for use both in salon and home environments.

SUMMARY OF THE INVENTION

According to the invention there is provided apparatus for curling hair comprising first and second side portions which are secured together in a spaced apart relationship via a connector portion, the connector portion being positioned substantially centrally with respect to each side portion; wherein the side portions are fabricated from a material which is both resilient and thermally conductive;

and wherein the first side portion is substantially flat and the second side portion is configured such that it is provided with two fixed states: a first state in which the first side portion is convex in shape and bends away from the second plate; and a second fixed state in which the first side portion is concave in shape and folds over to cover both the connector portion and the first side portion;

and wherein the first side portion is provided with at least one barrier member extending from the first side portion towards the second side portion in substantially the same direction as the connector portion and spaced apart from the connector portion, wherein the at least one barrier member has a height, and the connector portion has a length and the ratio of the height of the barrier member to the length of the connector portion is at least 1:3.

The second side portion is folded over the first side portion after the hair has been wound around the connector portion. This helps to hold the hair in place, to heat the hair rapidly and to secure the apparatus in the user's hair. Typically, the second side portion is slightly wider than the first side portion. The at least one barrier member helps to prevent hair from unwinding from the apparatus, by creating closed gateways to stop the anti-rotational gravitational force. This helps to keep hair trapped within the apparatus. The at least one barrier member also helps to conduct heat through the apparatus and to the hair held within it.

Preferably, the second side portion is provided with cooperating means for cooperating with the at least one barrier member.

The at least one barrier may be a substantially continuous wall extending around the connector portion, the wall including at least one slot in which a section of hair may be engaged.

The apparatus may comprise a plurality of barrier members in the form of spaced apart discrete wall elements.

The apparatus may comprise a plurality of barrier members in the form of spaced apart elongate protrusions. In a preferred embodiment, the apparatus comprises at least five elongate protrusions. Preferably, each elongate protrusion has a length of at least 5 mm. More preferably, each of the elongate protrusions has a length between 5 mm and 10 mm.

Preferably, the cooperating means for cooperating with the at least one barrier member comprises a plurality of holes shaped and positioned to align with the at least one barrier member when the second side portion is in the second fixed state.

Alternatively, the cooperating means for cooperating with the at least one barrier member may comprise a channel positioned such that the at least one barrier member locates within the channel when the second side portion is in the second fixed state.

The at least one barrier member may include at least one slot in which a section of hair may be engaged.

Preferably the connector portion is substantially cylindrical in shape. In use, hair to be curled is wound around the connector portion of the apparatus. The hair may be wound in-between the connector portion and the at least one barrier member. The barrier members may penetrate the section of hair wound around the connector portion.

Preferably, the connector portion has a length of not more than 40 mm. More preferably, the connector portion has a length not more than 20 mm. Advantageously, the connector portion is between 10 mm and 15 mm and more advantageously, 13 mm.

Preferably the side portions each have a width that is substantially larger than the length of the connector portion. More preferably, the side portions each have a width that is at least three times larger than the length of the connector portion, still more preferably, the side portions have a width that is less than ten times larger than the length of the connector portion. The ratio of width of the side portions to the length of the connector helps to ensure that all of the hair to be curled is covered by the side portions and helps ensure even delivery of heat to the hair during heating and from the hair during cooling.

The side portions may be between 60 and 80 mm wide and preferably between 65 and 75 mm wide and more preferably 70 mm wide.

Each of the first and second side portions may be circular in shape.

One or both of the side portions may include a plurality of holes therein. The advantage of such an arrangement is that heated hair may cool more quickly. Cooling of the hair is required to set the curl in the hair.

The connector portion may be provided with a plurality of holes therein. Preferably the connector portion is hollow.

According to another aspect of the invention there is provided a method of forming curls in hair using the apparatus described above, comprising the steps of:

(a) winding a section of hair around the connector portion of the apparatus;

(b) moving the second side portion from a first fixed state, to second fixed state;

(c) applying heat to the apparatus;

(d) allowing the apparatus to cool; and (e) removing the apparatus from the hair Advantageously, heat is applied to the apparatus using a heater. Preferably the heater is in the form of a heating tool, which may have heating plates of a shape corresponding to the shape of the apparatus. The heat may be applied to the apparatus by grasping the apparatus between a pair of heated plates, such as those on a hair straightener device.

Advantageously, the second side portion of the apparatus is provided with cooperating means for cooperating with the at least one barrier member and in step (b) the at least one barrier member located on the first side portion is aligned with and located into the cooperating means located on the second side portion.

Advantageously, the majority of the section of hair is wound into a channel located in-between the connector portion and the at least one barrier member.

The invention provides an improved apparatus and method for curling hair for use both in salon and home environments.

BRIEF DESCRIPTION OF THE DRAWINGS

In the drawings, which illustrate a preferred embodiment of apparatus for curling hair, and are by way of example.

DETAILED DESCRIPTION OF THE PREFERRED EMBODIMENTS

Figure 1A:
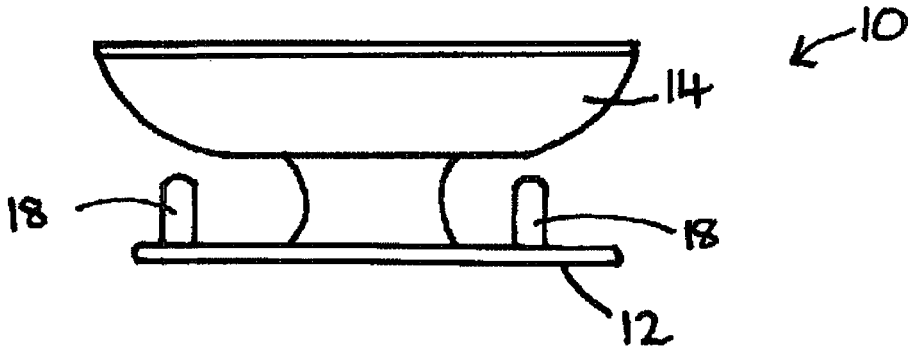
FIG. 1*a* is a side view of an embodiment of an apparatus for curling hair, in an open configuration.
Figure 1B:
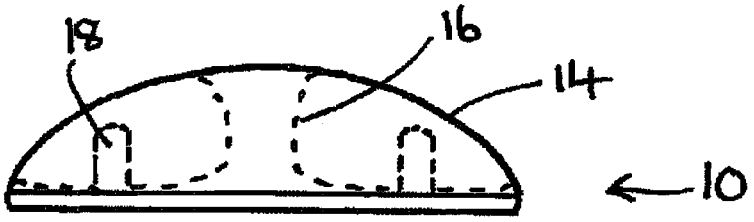
FIG. 1*b* is a side view of the apparatus of FIG. 1*a,* in a closed configuration.

Referring now to FIG. 1, an embodiment of a hair curling apparatus takes the form of a curler shown generally at 10. Curler 10 comprises two spaced apart side portions 12, 14 connected by a connector portion 16. The first side portion 12 is substantially flat in profile and the second side portion 14 is curved in shape. In this embodiment, the first side portion 12 is provided with barrier members in the form of five elongate protrusions, or posts 18 which extend towards the second side portion 14, in substantially the same direction as the connector portion 16. The elongate protrusions 18 may be located on either of the side portions, but it is preferable, as shown in the illustrated example, that the elongate protrusions 18 are spaced apart on the first side portion 12 and positioned in-between the connector portion 16 and the outer circumference of the first, substantially flat, side portion 12. The second side portion 14 is configured such that it has two fixed states. The first fixed state is illustrated in FIG. 1*a,* where the second side portion 14 is convex in shape and curves away from the first side portion 12. This is the open configuration of the curler 10, and allows for hair to be wound around the connector portion 16. The second fixed state is illustrated in FIG. 1*b,* whereby the second side portion 14 has been folded over so that it is now concave in shape and curves over the top of the connector portion 16 and the first side portion 12. This is the closed configuration of the curler 10, and allows hair wrapped around the connector portion 16 to be secured within the curler 10. In the illustrated example the curler 10 has a diameter of approximately 70 mm, the length of the connector portion 14 is approximately 15 mm and the length of each of the elongate protrusions 18 is approximately 9 mm. The width of each elongate protrusion is approximately 4 mm. Typically, the side second side portion is slightly wider than the first side portion. The length of the elongate protrusions 18 should be less than or equal to the length of the connector portion 14 to allow hair to be easily wound around the connector portion 16, however the elongate protrusions 18 must also have sufficient length such that they form a bridge between the first and second side portions 12, 14 when the curler is in the closed configuration.

Figure 2A:
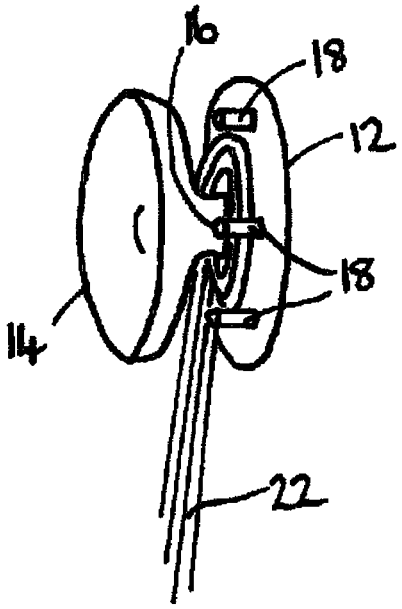
FIG. 2*a* is a schematic representation showing a section of hair wound onto the apparatus with the apparatus in an open configuration.
Figure 2B:
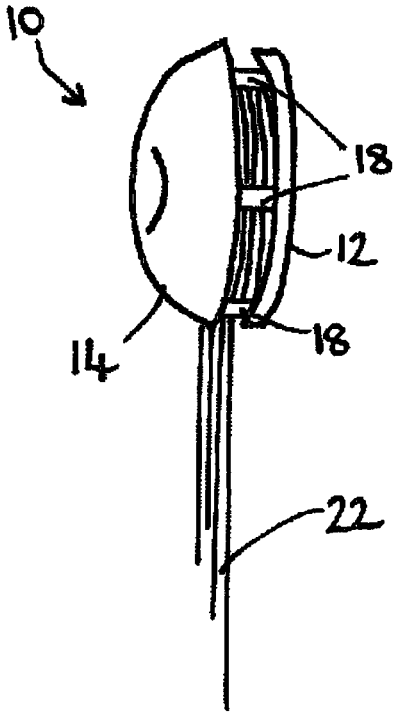
FIG. 2*b* is a schematic representation showing the section of hair wound onto the apparatus with the apparatus in a closed configuration.

FIG. 2*a* illustrates hair 22 wound onto the curler 10 with the curler 10 in an open configuration. FIG. 2*b* illustrates hair 22 wound onto the curler 10, with the curler 10 in a closed configuration. As shown in FIG. 2*a,* most of the hair 22 is located between the connector portion 16 and the elongate protrusions 18. When the curler 10 is in a closed configuration the elongate protrusions 18 form a barrier preventing hair from unwinding from the curler 10, helping to keep hair trapped within the curler 10.

The curler 10 is fabricated from a silicon rubber that is thermally conductive. This allows the curler 10, and the hair within it to be heated, once the curler 10 is in a closed configuration. Conventional hair straightening irons may be used to heat the curler 10 by clamping the jaws of the straightening irons around the curler 10. The barrier members or protrusions 18 also help to conduct heat from the straightening irons to the hair. The thermally conductive silicon rubber may include thermochromic pigments so that the curler 10 changes colour with temperature. Preferably the thermochromic pigment changes colour at around 30° C., indicating that the hair has cooled sufficiently to set the curl.

Figure 3A:
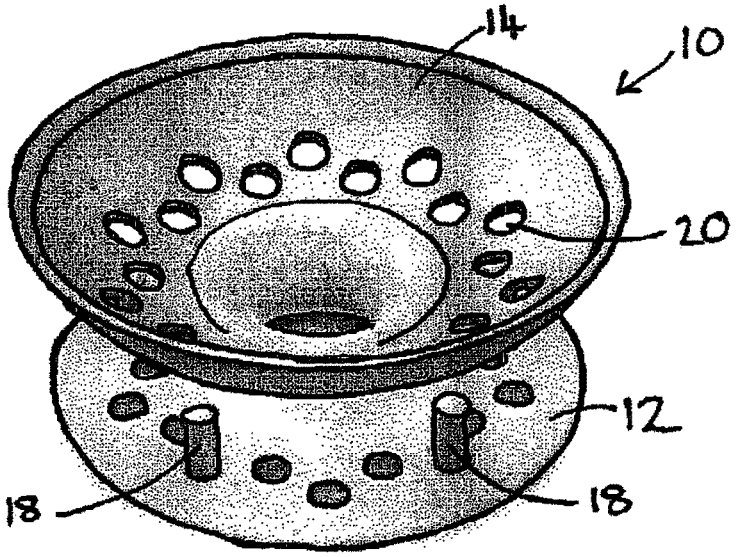
FIG. 3*a* is an isometric view of a further embodiment of an apparatus for curling hair, in an open configuration.
Figure 3B:
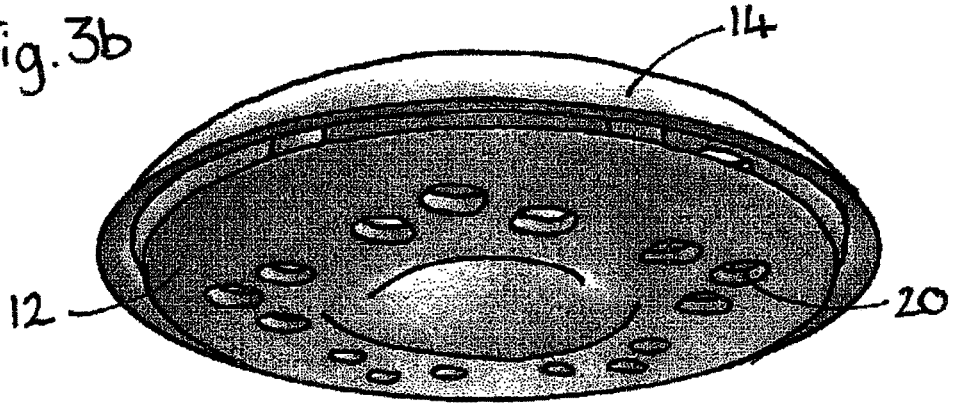
FIG. 3*b* is an isometric view of the apparatus of FIG. 3*a,* in a closed configuration.

As shown in FIGS. 3*a,* 3*b* and 3*c,* either one, or both, of the side portions 12, 14 may be formed with holes 20 therein. The connector portion 16 could also be provided with such holes. Where provided, the holes 20 would typically be made across the whole of one or both of the side portions 12, 14. If holes 20 are present they are preferably evenly spaced around the side portions 12, 14 and/or the connector portion 16. The holes 20 are an optional feature which allow circulation of air to hair wound around the connector portion 16 which may help hasten the drying of wet hair within the curler 10, or simply to aid cooling of heated hair within the curler 10. Some of the holes 20 on the second side portion 14 may align with elongate protrusions 18 located on the first side portion 12, and vice versa, such that at least part of the elongate protrusions 18 locate into some of said holes 20.

Figure 3C:
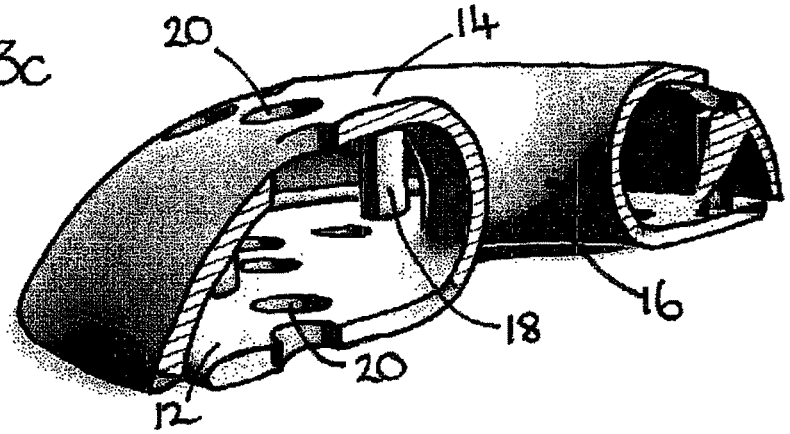
FIG. 3*c* shows a cross section through the apparatus of FIG. 3*b,* with the apparatus in a closed configuration.

As shown in FIG. 3*c,* the connector portion 16 is preferably hollow, this makes the curler 10 more flexible and allows the curler 10 to be compressed between two heated surfaces to more efficiently heat the hair located within the curler 10.

Figure 4A:
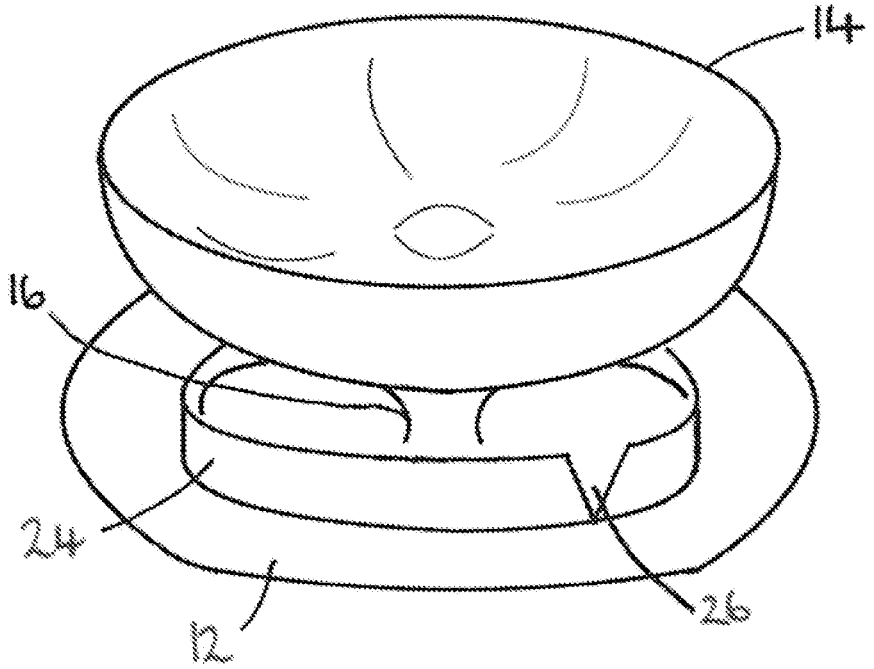
FIG. 4*a* and FIG. 4*b* are isometric views of a further embodiment of an apparatus for curling hair.
Figure 4B:
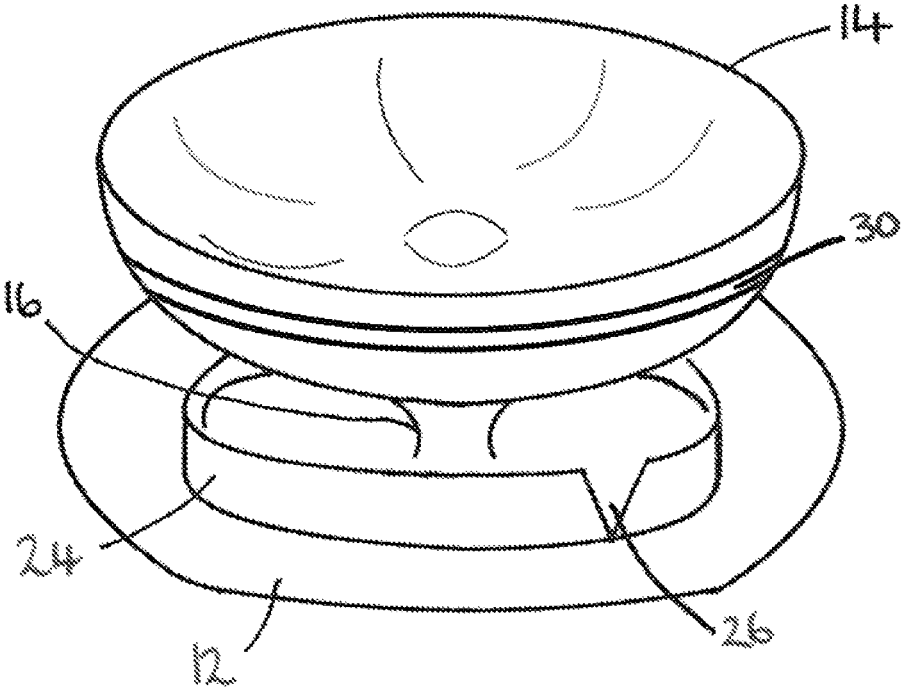

As shown in FIG. 4*a*, the barrier member may take the form of a substantially continuous wall 24, the wall 24 being provided with at least one slot 26 for receipt of the section of hair to be wound around the connector portion 16. The underside of the second side portion 14 may, as shown in FIG. 4*b*, include a channel 30 into which the wall 24 locates when the second side portion 14 is flipped over into the second fixed state.

Figure 5A:
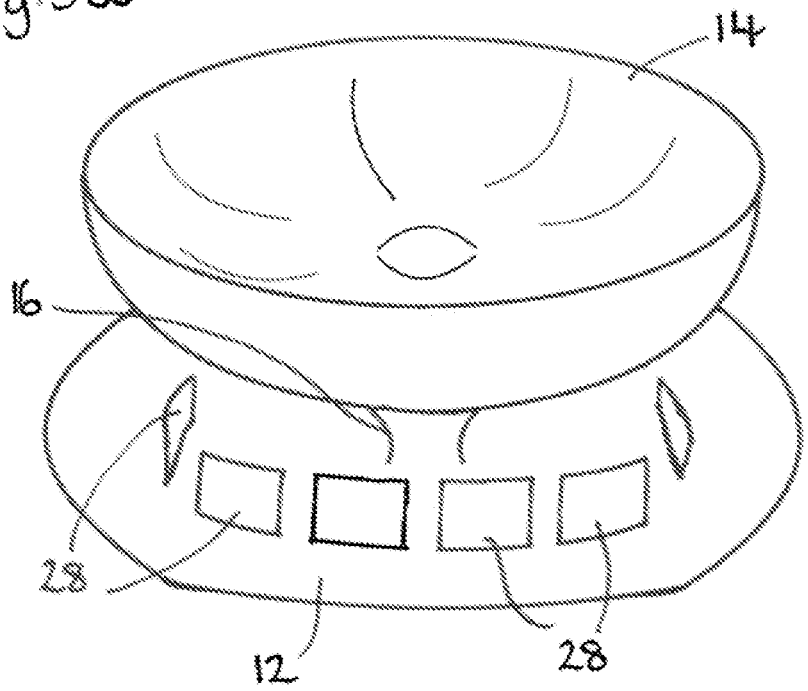
FIG. 5*a* and FIG. 5*b* are isometric views of a yet further embodiment of an apparatus for curling hair, in an open configuration.
Figure 5B:
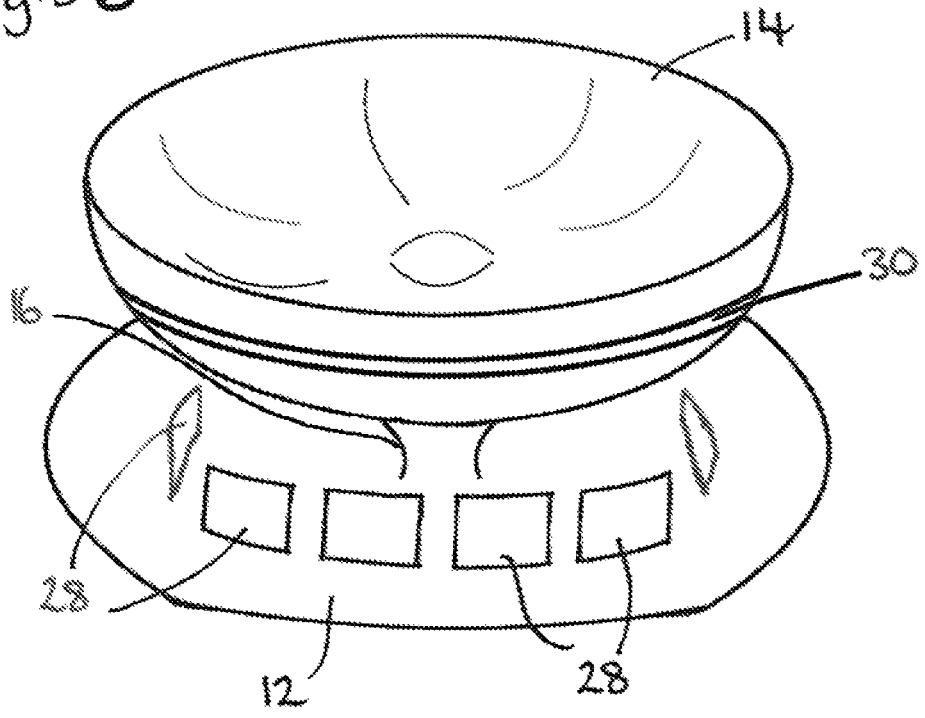

As shown in FIG. 5*a*, the barrier member may take the form of a series of discrete wall portions 28, with the section of hair to be wound around the connector portion 16 passing through the gaps between the wall portions 28. The underside of the second side portion 14 may, as shown in FIG. 5*b* include a channel 30 or elongate holes into which the wall portions 28 locate when the second side portion 14 is flipped over into the second fixed state.

The invention claimed is:

1. Apparatus for curling hair comprising first and second side portions which are secured together in a spaced apart relationship via a connector portion, the connector portion being positioned substantially centrally with respect to each side portion; and wherein the side portions are fabricated from a material which is both resilient and thermally conductive;

wherein the first side portion is substantially flat and the second side portion is configured such that it is provided with two fixed states: a first state in which the second side portion is convex in shape and bends away from the first side portion; and a second fixed state in which the second side portion is concave in shape and folds over to cover both the connector portion and the first side portion;

wherein the first side portion is provided with at least one barrier member extending from the first side portion towards the second side portion in substantially the same direction as the connector portion and spaced apart from the connector portion such that a section of hair may be received in between the at least one barrier member and the connector portion, wherein the at least one barrier member has a height, and the connector portion has a length and the ratio of the height of the barrier member to the length of the connector portion is at least 1:3.

2. Apparatus for curling hair according to claim 1, wherein the second side portion is provided with cooperating means for cooperating with the at least one barrier member.

3. Apparatus for curling hair according to claim 2, wherein the cooperating means for cooperating with the at least one barrier member is selected from the group comprising: a plurality of holes shaped and positioned to align with the at least one barrier member when the second side portion is in the second fixed state and a channel positioned such that the at least one barrier member locates within the channel when the second side portion is in the second fixed state.

4. Apparatus for curling hair according to claim 1, wherein the at least one barrier member is selected from the group comprising: a substantially continuous wall extending around the connector portion, the wall including at least one slot for receiving a section of hair; a plurality of barrier members in the form of spaced apart discrete wall elements; and a plurality of barrier members in the form of spaced apart elongate protrusions.

5. Apparatus for curling hair according to claim 4, comprising at least five elongate protrusions.

6. Apparatus for curling hair according to claim 4, wherein each elongate protrusion has a length selected from the group comprising: at least 5 mm; between 5 mm and 10 mm; and not more than 20 mm.

7. Apparatus for curling hair according to claim 1, wherein the connector portion has a length of not more than 40 mm.

8. Apparatus for curling hair according to claim 1, wherein the at east one barrier member includes at least one slot in which a section of hair may he engaged.

9. Apparatus for curling hair according to claim 1, wherein the connector portion is substantially cylindrical in shape.

10. Apparatus for curling hair according to claim 1, the side portions each having a width that is substantially larger than the length of the connector portion.

11. Apparatus for curling hair according to claim 1, the side portions each having a width that is at least three times larger than the length of the connector portion.

12. Apparatus for curling hair according to claim 11, the side portions each having a width that is less than ten times larger than the length of the connector portion.

13. Apparatus for curling hair according to claim 1. wherein each of the first and second side portions are circular in shape.

14. Apparatus for curling hair according to claim 1, wherein at least one of the first and second side portions are provided with a plurality of holes therein.

15. Apparatus for curling hair according to claim 1, wherein the apparatus is fabricated from a silicon rubber material.

16. Apparatus for curling hair according to claim 15, wherein at least the second side portion includes at least one thermochromic pigment.

17. A method for curling hair using the apparatus of claim 1 comprising the steps of:

(a) winding a section of hair around the connector portion of the apparatus;

(b) moving the second side portion from a first fixed state, to second fixed state;

(c) applying heat to the apparatus;

(d) allowing the apparatus to cool; and (c) removing the apparatus from the hair.

18. A method of curing hair according to claim 17, wherein the second side portion of the apparatus is provided with cooperating means for cooperating with the at least one barrier member and in step (b) the at least one barrier member located on the first side portion is aligned with and located into the cooperating means located on the second side portion.

19. A method of curling hair according to claim 17, wherein the heat is applied to the apparatus by grasping the apparatus between a pair of heated plates.

20. A method of curling hair according to claim 17, wherein the majority of the section of hair is wound into a channel located in-between the connector portion and the at least one barrier member.

* * * * *